US012116644B2

(12) United States Patent
Yoshida et al.

(10) Patent No.: US 12,116,644 B2
(45) Date of Patent: Oct. 15, 2024

(54) COOLING JACKET AND QUENCHING APPARATUS

(71) Applicant: Neturen Co., Ltd., Tokyo (JP)

(72) Inventors: Hiroshi Yoshida, Tokyo (JP); Takashi Horino, Tokyo (JP); Hidehiro Yasutake, Tokyo (JP)

(73) Assignee: Neturen Co., Ltd., Tokyo (JP)

( * ) Notice: Subject to any disclaimer, the term of this patent is extended or adjusted under 35 U.S.C. 154(b) by 41 days.

(21) Appl. No.: 17/708,078

(22) Filed: Mar. 30, 2022

(65) Prior Publication Data

US 2022/0316018 A1 Oct. 6, 2022

(30) Foreign Application Priority Data

Mar. 31, 2021 (JP) ..... 2021-59089

(51) Int. Cl.
*C21D 1/667* (2006.01)
*C21D 9/32* (2006.01)

(52) U.S. Cl.
CPC ..... *C21D 1/667* (2013.01); *C21D 9/32* (2013.01)

(58) Field of Classification Search
CPC . C21D 1/667; C21D 9/32; C21D 1/10; C21D 9/0062; C21D 11/005
See application file for complete search history.

(56) References Cited

U.S. PATENT DOCUMENTS 10,100,380 B2 * 10/2018 Matsuoka ..... C21D 1/667
2017/0058374 A1 * 3/2017 Matsui ..... C21D 1/18

FOREIGN PATENT DOCUMENTS

JP 11335726 A * 12/1999
JP 2016049568 A * 4/2016
JP 2019183237 A * 10/2019 ..... G03B 1/66

* cited by examiner

*Primary Examiner* — Keith D. Hendricks
*Assistant Examiner* — Moriah S. Smoot
(74) *Attorney, Agent, or Firm* — RANKIN, HILL & CLARK LLP

(57) ABSTRACT

A cooling jacket includes a coolant supply member that circulates a coolant, and a coolant injection member to which the coolant is supplied from the coolant supply member, the coolant injection member provided with multiple injection holes through which the coolant is injected. The coolant injection surface of the coolant injection member opposing the workpiece has an upper region, a central region, and a lower region arranged along a vertical direction. An area of each injection hole provided in the central region is larger than an area of each injection hole provided in the upper region and an area of each injection hole provided in the lower region. The coolant injection member moves relative to a workpiece in a horizontal direction. A densest direction in which the multiple injection holes are arranged at the shortest intervals is inclined with respect to both the horizontal direction and the vertical direction.

5 Claims, 8 Drawing Sheets

COOLING JACKET AND QUENCHING APPARATUS

BACKGROUND

Technical Field

An embodiment of the present invention relates to a cooling jacket and a quenching apparatus.

Related Art

A quenching apparatus that performs quenching treatment on a steel component (hereinafter, referred to as "workpiece") by heating the workpieces to a high temperature equal to or higher than an austenite transformation point and subsequently rapidly cooling the workpiece is used. In such a quenching apparatus, in order to perform homogeneous quenching treatment to a workpiece, it is necessary to homogeneously cool a surface of the heated workpiece to be quenched. However, if the workpiece is large or has a complicated shape, homogeneous cooling is difficult.

CITATION LIST

Patent Literature

Patent Literature 1: JP-A-2007-204834

SUMMARY

An object of an embodiment of the present invention is to provide a cooling jacket and a quenching apparatus that can homogenize a cooling rate.

A cooling jacket according to an embodiment of the present invention includes: a coolant supply member that circulates a coolant; and a coolant injection member to which the coolant is supplied from the coolant supply member, the coolant injection member provided with a plurality of injection holes through which the coolant is injected. A surface of the coolant injection member opposing a workpiece has an upper region, a central region, and a lower region arranged along a vertical direction. An area of each of the injection holes provided in the central region is larger than an area of each of the injection holes provided in the upper region and an area of each of the injection holes provided in the lower region. The coolant injection member moves relative to the workpiece in a horizontal direction. A densest direction in which the plurality of injection holes are arranged at shortest intervals is inclined with respect to both the horizontal direction and the vertical direction.

A quenching apparatus according to an embodiment of the present invention includes the cooling jacket and a heating unit that heats the workpiece.

According to an embodiment of the present invention, it is possible to achieve a cooling jacket and a quenching apparatus that can homogenize a cooling rate.

DETAILED DESCRIPTION

Embodiment

An embodiment of the present invention will be described below with reference to the drawings.

Figure 1:
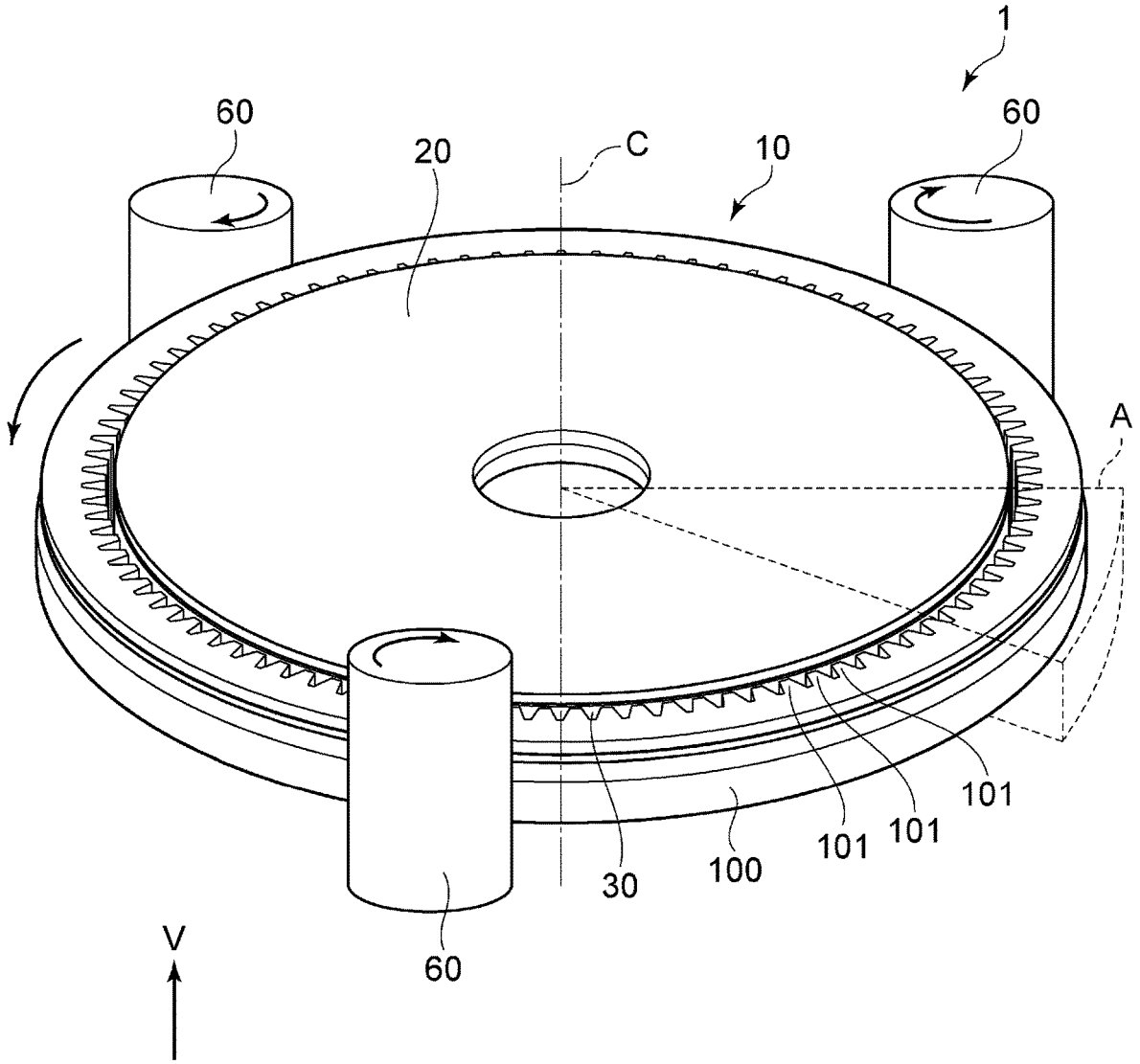
FIG. 1 is a perspective view illustrating a quenching apparatus according to an embodiment.

FIG. 1 is a perspective view illustrating the quenching apparatus according to the present embodiment.

Figure 2:
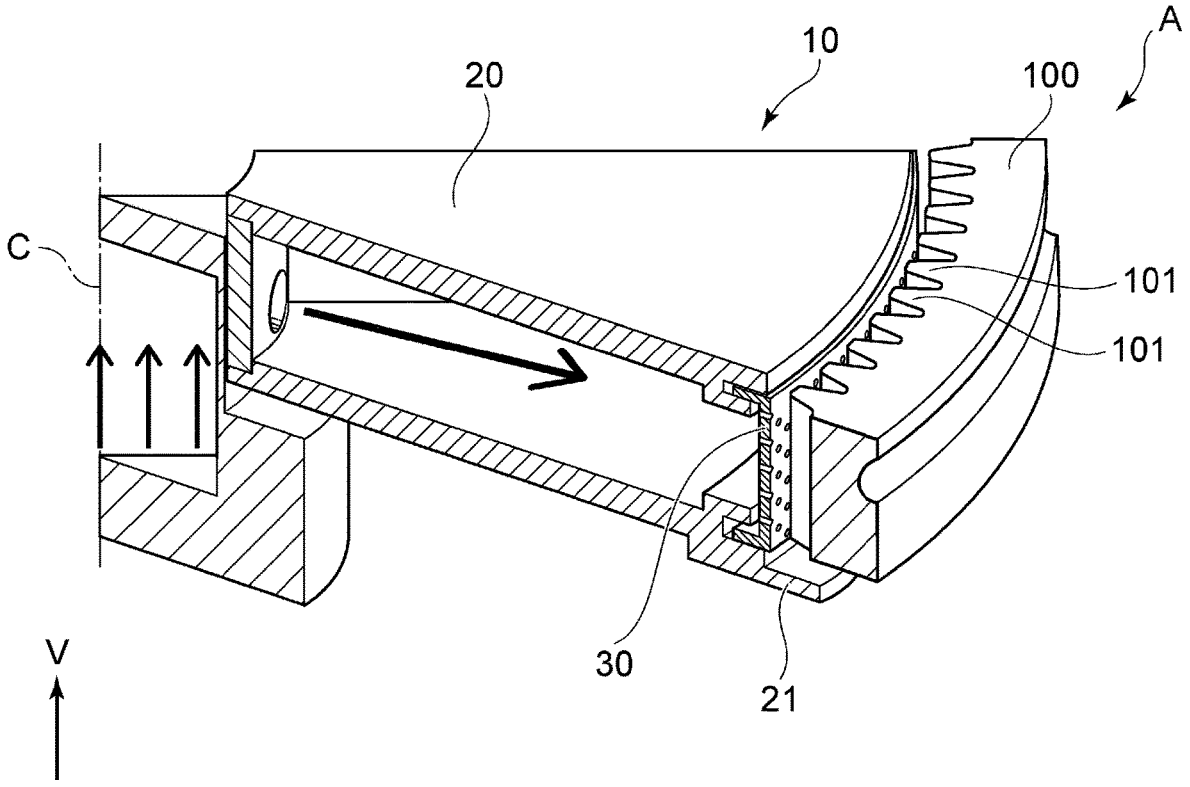
FIG. 2 is a perspective cross-sectional view illustrating a region in FIG. 1.

FIG. 2 is a perspective cross-sectional view illustrating the region A in FIG. 1.

Figure 3:
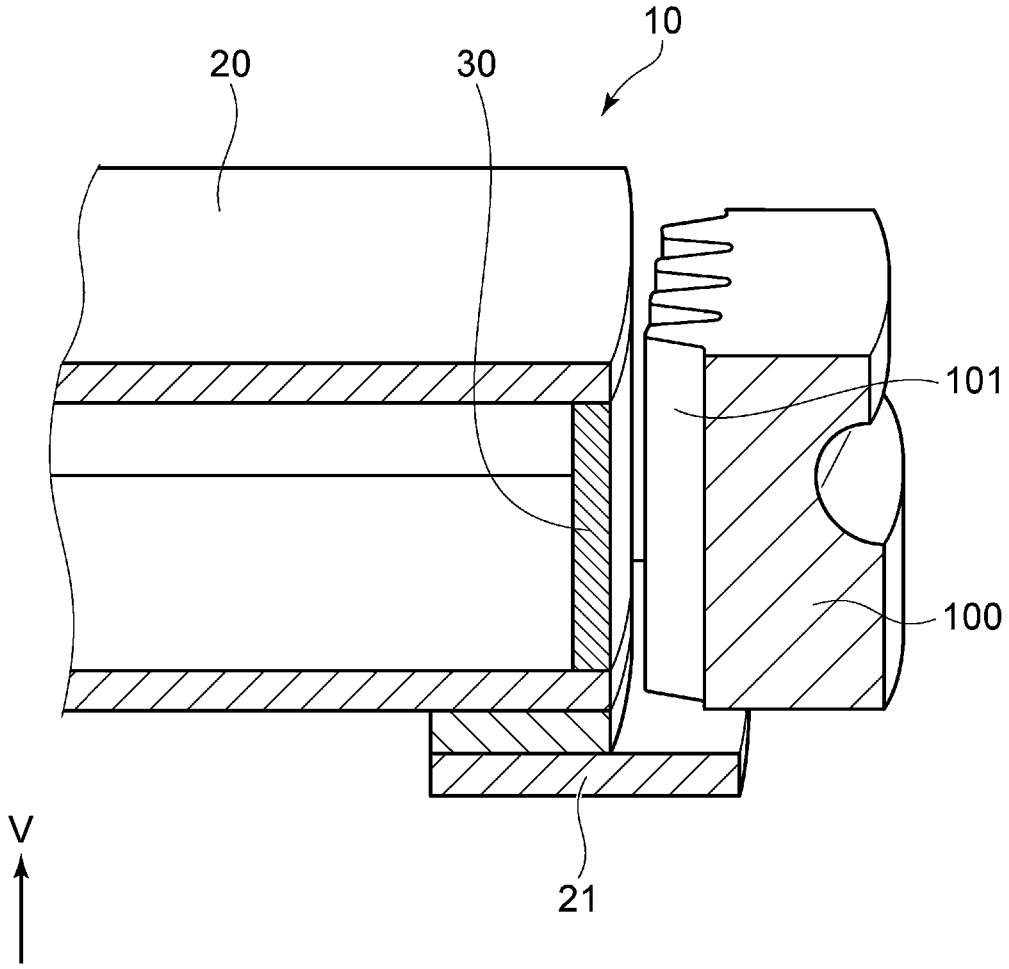
FIG. 3 is an enlarged perspective cross-sectional view illustrating a cooling jacket according to the embodiment.

FIG. 3 is an enlarged perspective cross-sectional view illustrating the cooling jacket according to the present embodiment.

Figure 4:
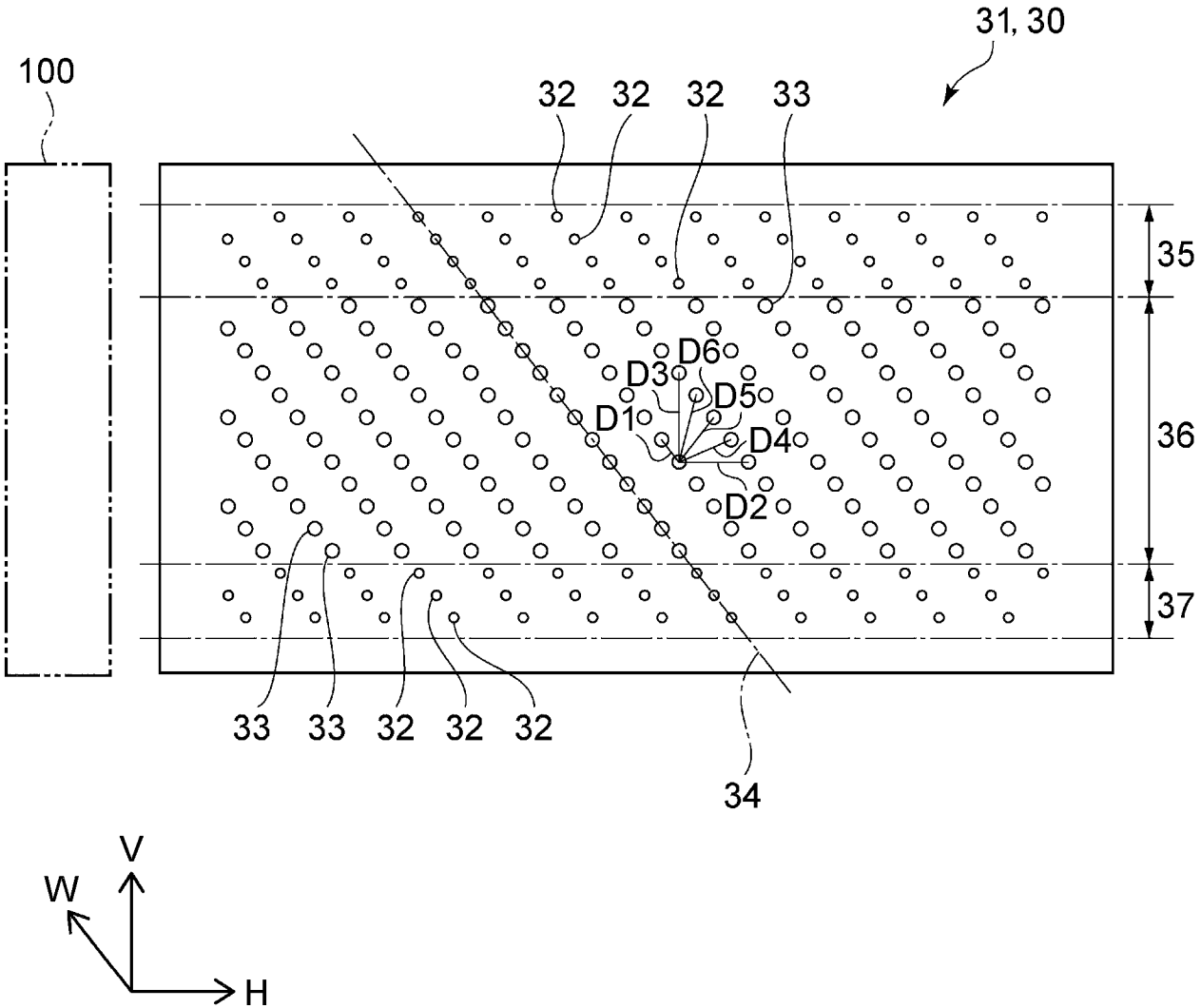
FIG. 4 is a side view illustrating a coolant injection surface of the cooling jacket according to the embodiment.

FIG. 4 is a side view illustrating a coolant injection surface of the cooling jacket according to the present embodiment.

As illustrated in FIG. 1, a workpiece 100 to be subjected to the quenching treatment in the present embodiment is, for example, a turning wheel. The entire shape of the workpiece 100 is substantially annular, and the inner surface of the workpiece 100 is provided with a plurality of teeth 101. The plurality of teeth 101 is cyclically arranged along the circumferential direction of the workpiece 100. A quenching apparatus 1 according to the present embodiment performs quenching treatment on the inner surface of the workpiece 100.

The quenching apparatus 1 includes a cooling jacket 10, a heating unit, and a moving unit 60. In the present embodiment, the cooling jacket 10 is disposed inside the workpiece 100, and the moving unit 60 is disposed outside the workpiece 100. The moving unit 60 is, for example, a driving roller that rotates the workpiece 100 by abutting on the outer peripheral surface of the workpiece 100. By rotating the workpiece 100, the moving unit 60 moves the workpiece 100 relative to the cooling jacket 10.

As illustrated in FIGS. 1 to 3, the cooling jacket 10 is provided with a coolant supply member 20 and a coolant injection member 30. The coolant supply member 20 has a substantially disk shape. In the coolant supply member 20, a coolant circulation route is provided. The coolant supply member 20 is supplied with a coolant from the outside through the center of the lower surface, for example, and distributes this coolant to the outer peripheral surface of the coolant supply member 20.

The coolant injection member 30 is attached to the outer peripheral surface of the coolant supply member 20. The coolant injection member 30 has a ring shape. The outer peripheral surface of the coolant injection member 30 is a coolant injection surface 31. The coolant injection surface 31 opposes the inner peripheral surface of the workpiece 100. A central axis C of the cooling jacket 10 extends in a vertical direction V.

The heating unit is disposed in the cooling jacket 10 and is incorporated in the coolant injection member 30, for example. The heating unit is, for example, a high-frequency induction coil. A plate member 21 is attached to the lower surface of the coolant supply member 20. The plate member 21 is disposed below a gap between the coolant injection member 30 and the workpiece 100.

The moving unit 60 moves the coolant injection surface 31 relative to the workpiece 100 in the circumferential direction of the workpiece 100. The circumferential direction of the workpiece 100 is parallel to the horizontal plane and is a type of a horizontal direction H.

As illustrated in FIG. 4, the coolant injection surface 31 of the coolant injection member 30 is provided with a plurality of injection holes 32 and 33. The injection holes 32 and 33 are holes for injecting, to the workpiece 100, the coolant supplied by the coolant supply member 20. The direction in which the injection holes 32 and 33 extend is, for example, the radial direction of the cooling jacket 10 and the horizontal direction. The injection holes 32 and 33 have, for example, a cylindrical shape. The diameter of the injection hole 33 is larger than the diameter of the injection hole 32. Therefore, in the coolant injection surface 31, the area of each injection hole 33 is larger than the area of each injection hole 32.

On the coolant injection surface 31, the injection holes 32 and 33 are two-dimensionally arranged in a plurality of rows. A row 34 illustrated in FIG. 4 is a row in which the injection holes 32 and 33 are arranged at the shortest intervals. That is, among the distances between injection holes adjacent to each other, a distance D1 in a densest direction W in which the row 34 extends is shorter than any of a distance D2 in the horizontal direction H, a distance D3 in the vertical direction V, and distances D4, D5, and D6 in other directions. The densest direction W is inclined with respect to both the vertical direction V and the horizontal direction H. On the coolant injection surface 31, a plurality of the rows 34 is provided and arranged cyclically or substantially cyclically along the circumferential direction of the coolant injection member 30.

On the coolant injection surface 31, an upper region 35, a central region 36, and a lower region 37 are set along the vertical direction V. The lower region 37 is located below the upper region 35, that is, in the direction of gravity. The central region 36 is disposed between the upper region 35 and the lower region 37. The upper region 35 and the lower region 37 are provided with the injection holes 32. The central region 36 is provided with the injection holes 33. Therefore, the area of each injection hole provided in the central region 36 is larger than the area of each injection hole provided in the upper region 35 and the area of each injection hole provided in the lower region 37.

The length of the central region 36 in the vertical direction V is longer than the length of the upper region 35 in the vertical direction V and longer than the length of the lower region 37 in the vertical direction V. For example, the length of the central region 36 in the vertical direction V is longer than the sum of the length of the upper region 35 and the length of the lower region 37 in the vertical direction V. In the example illustrated in FIG. 4, the upper region 35 is provided with four tiers of the injection holes 32 along the vertical direction V, the central region 36 is provided with 12 tiers of the injection holes 33 along the vertical direction V, and the lower region 37 is provided with three tiers of the injection holes 32 along the vertical direction V.

In FIG. 4, the position of the workpiece 100 is also indicated by a two-dot chain line. As illustrated in FIGS. 2 to 4, in the vertical direction V, the position of the upper edge of the coolant injection surface 31 is substantially equal to the position of the upper edge of the workpiece 100, and the position of the lower edge of the coolant injection surface 31 is substantially equal to the position of the lower edge of the workpiece 100.

Next, the operation of the quenching apparatus 1 according to the present embodiment will be described.

As illustrated in FIG. 1, the workpiece 100 is disposed such that the inner surface opposes the cooling jacket 10 and the outer surface abuts on the moving unit 60. At this time, the central axis of the workpiece 100 is aligned with the central axis C of the cooling jacket 10.

Next, the moving unit 60 rotates the workpiece 100. Due to this, the coolant injection member 30 of the cooling jacket 10 moves relative to the workpiece 100 in the horizontal direction H.

Next, the heating unit of the coolant injection member 30 heats the workpiece 100. At this time, if the workpiece 100 is made of steel, the workpiece is heated to a temperature equal to or higher than the austenite transformation point. Thereafter, the heating unit is stopped.

Next, the coolant is supplied into the coolant supply member 20. The coolant is, for example, a polymer aqueous solution or water. The coolant circulates in the coolant supply member 20, reaches the coolant injection member 30, and is injected from the injection holes 32 and 33. The injected coolant comes into contact with the inner surface of the workpiece 100. Due to this, the workpiece 100 is cooled. As a result, quenching treatment is performed on the inner surface of the workpiece 100.

Hereinafter, the cooling process will be described in more detail.

Figure 5A:
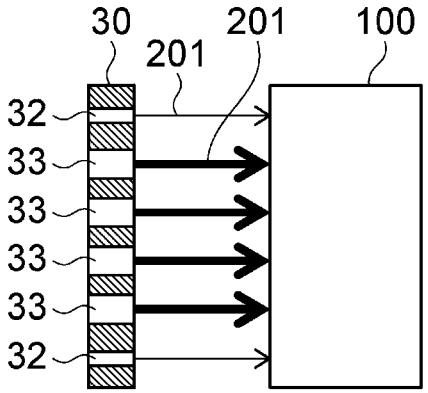
FIGS. 5A to 5C are views schematically illustrating an operation of the cooling jacket according to the embodiment.
Figure 5B:
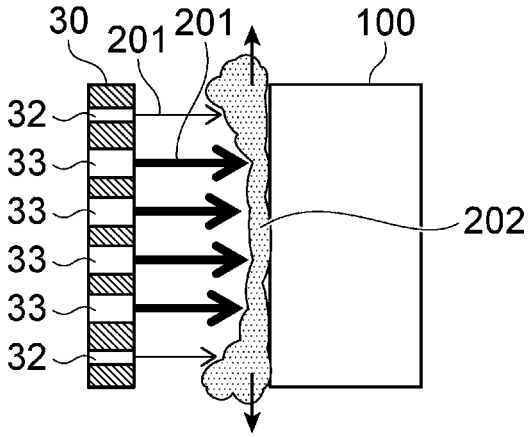
Figure 5C:
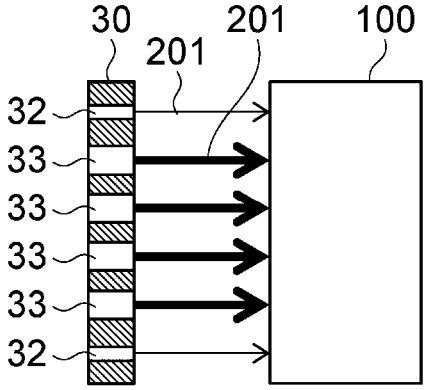

FIGS. 5A to 5C are views schematically illustrating the operation of the cooling jacket according to the present embodiment.

FIGS. 5A to 5C illustrate an initial stage of cooling. In FIGS. 5A to 5C, injection of the coolant is indicated by an arrow, and a thick arrow indicates that the injection amount is larger than that indicated by a thin arrow. The same applies to FIGS. 7A to 7D described later.

As illustrated in FIG. 5A, a coolant 201 is injected from the injection holes 32 and 33 of the coolant injection member 30. At this time, since the upper region 35 and the lower region 37 of the coolant injection member 30 are provided with the injection holes 32, which are relatively small, the injection amount of the coolant 201 is relatively small. Since the central region 36 is provided with the injection holes 33, which are relatively large, the injection amount of the coolant 201 is relatively large. The coolant 201 injected at the first timing of the cooling process comes into contact with the workpiece 100 and exchanges heat with the workpiece 100.

As illustrated in FIG. 5B, the coolant 201 in contact with the workpiece 100 evaporates to form a vapor layer 202 along the inner surface of the workpiece 100. The vapor layer 202 inhibits the coolant 201 injected thereafter from reaching the workpiece 100. However, since the injection amount of the coolant 201 in the central region 36 is larger than the injection amount of the coolant 201 in the upper region 35 and the lower region 37, the vapor layer 202 is pushed out up and down by the coolant 201.

Therefore, as illustrated in FIG. 5C, the vapor layer 202 is quickly removed, and the coolant 201 comes into contact with the workpiece 100 again. Due to this, the workpiece 100 is continuously cooled.

Some of the coolant in contact with the inner surface of the workpiece 100 move downward in the gap between the coolant injection member 30 and the workpiece 100, retains on the plate member 21 for a short time, comes into contact with the lower surface of the workpiece 100, and then drops. The rest of the coolant in contact with the inner surface of the workpiece 100 moves upward in the gap between the coolant injection member 30 and the workpiece 100, retains on the workpiece 100 and the cooling jacket 10 for a short time, comes into contact with the upper surface of the workpiece 100, and then drops mainly from the outside of the workpiece 100.

When the workpiece 100 is sufficiently cooled, the supply of the coolant 201 is stopped, and the moving unit 60 is stopped. In this manner, the quenching apparatus 1 performs the quenching treatment on the inner surface of the workpiece 100.

Next, effects of the present embodiment will be described.

In the cooling jacket 10 according to the present embodiment, on the coolant injection surface 31, the area of each injection hole 33 provided in the central region 36 is larger than the area of each injection hole 32 provided in the upper region 35 and the area of each injection hole 32 provided in the lower region 37. This allows the vapor layer 202 generated along the inner surface of the workpiece 100 to be quickly discharged up and down, and the coolant 201 injected thereafter to be quickly brought into contact with the workpiece 100. As a result, the cooling efficiency in the center of the vertical direction of the workpiece 100 is improved. The center of the vertical direction in the workpiece 100 is less likely to be cooled than the upper part and the lower part. Therefore, by improving the cooling efficiency in the center of the vertical direction in the workpiece 100, it is possible to homogenize the cooling rate.

Since the cooling jacket 10 is provided with the plate member 21, the coolant 201 dropped from the gap between the coolant injection member 30 and the workpiece 100 can be retained on the plate member 21 for a short time and brought into contact with the lower surface of the workpiece 100. This makes it possible to efficiently cool also the lower surface of the workpiece 100. Since the coolant 201 retains on the upper surface of the workpiece 100 for a short time, if the plate member 21 is not provided, the cooling rate of the lower surface of the workpiece 100 becomes possibly lower than the cooling rate of the upper surface. On the other hand, in the present embodiment, since the plate member 21 is provided, the cooling rates can be equalized between the upper surface and the lower surface of the workpiece 100. This too makes it possible to homogenize the cooling rate of the workpiece 100.

Since the coolant injection member 30 moves relative to the workpiece 100 in the horizontal direction, an arbitrary position on the inner surface of the workpiece 100 sequentially opposes the plurality of injection holes arranged in the horizontal direction on the coolant injection surface 31. Therefore, in order to improve the cooling efficiency of the workpiece 100, it is preferable to increase the number of tiers of the injection holes in the vertical direction V as much as possible in a rectangular region of the coolant injection surface 31 in which line segments extending in the vertical direction V on the inner surface of the workpiece 100 oppose each other in a predetermined cooling period.

In the present embodiment, on the coolant injection surface 31, the densest direction W in which the row 34 where the injection holes 32 and 33 are arranged at the shortest intervals extends is inclined with respect to both the horizontal direction H and the vertical direction V. This makes it possible to increase the number of tiers of the injection holes in the vertical direction V in the above-described rectangular region.

Since the densest direction W is inclined with respect to the vertical direction V, the injection holes 32 and 33 can be densely arranged along the vertical direction V. More specifically, in the example illustrated in FIG. 4, the injection holes 32 are arranged in four tiers in the upper region 35, the injection holes 33 are arranged in 12 tiers in the central region 36, the injection holes 32 are arranged in three tiers in the lower region 37, and the injection holes are arranged in the total of 19 tiers along the vertical direction V. On the other hand, if the densest direction W is aligned with the vertical direction V, when the distance D1 is constant, the number of tiers of the injection holes along the vertical direction V becomes smaller than 19 tiers.

On the other hand, also by the densest direction W being inclined with respect to the horizontal direction H, the number of tiers of the injection holes along the vertical direction V can be increased in the above-described rectangular region. More specifically, if the densest direction W is aligned with the horizontal direction H, the direction in which the rows 34 are arrayed, that is, the direction orthogonal to the densest direction W of the injection holes is aligned with the vertical direction V, and the number of tiers of the injection holes in the vertical direction V is reduced. In this case, even when the workpiece 100 moves in the horizontal direction with respect to the coolant injection member 30, the position of the injection holes in the vertical direction V does not change, and therefore the effect of increasing the number of tiers of the injection holes along the vertical direction V is difficult to achieved.

Furthermore, since the densest direction W is inclined with respect to both the horizontal direction H and the vertical direction V, the position where the coolant is injected temporally changes at the tooth bottom between the teeth 101 adjacent to each other in the workpiece 100. Due to this, movement of the coolant along the vertical direction V is generated at the tooth bottom of the workpiece 100. This too makes it possible to homogenize the cooling rate of the workpiece 100.

When the workpiece 100 is annular, the inner surface has a smaller surface area per unit volume than that of the outer surface, and thus is less likely to be cooled. When the workpiece 100 is provided with the teeth 101, the tooth bottom has a smaller surface area per unit volume than that of the tooth tip, and thus is less likely to be cooled. Therefore, the tooth bottom of the inner surface of the workpiece 100 generally has low cooling efficiency. In the present embodiment, by forming the injection holes 32 and 33 as described above, it is possible to improve the cooling efficiency even at the tooth bottom of the inner surface of the workpiece 100. As a result, it is possible to homogenize the cooling rate of the workpiece 100.

Comparative Example

Next, a comparative example will be described.

Figure 6:
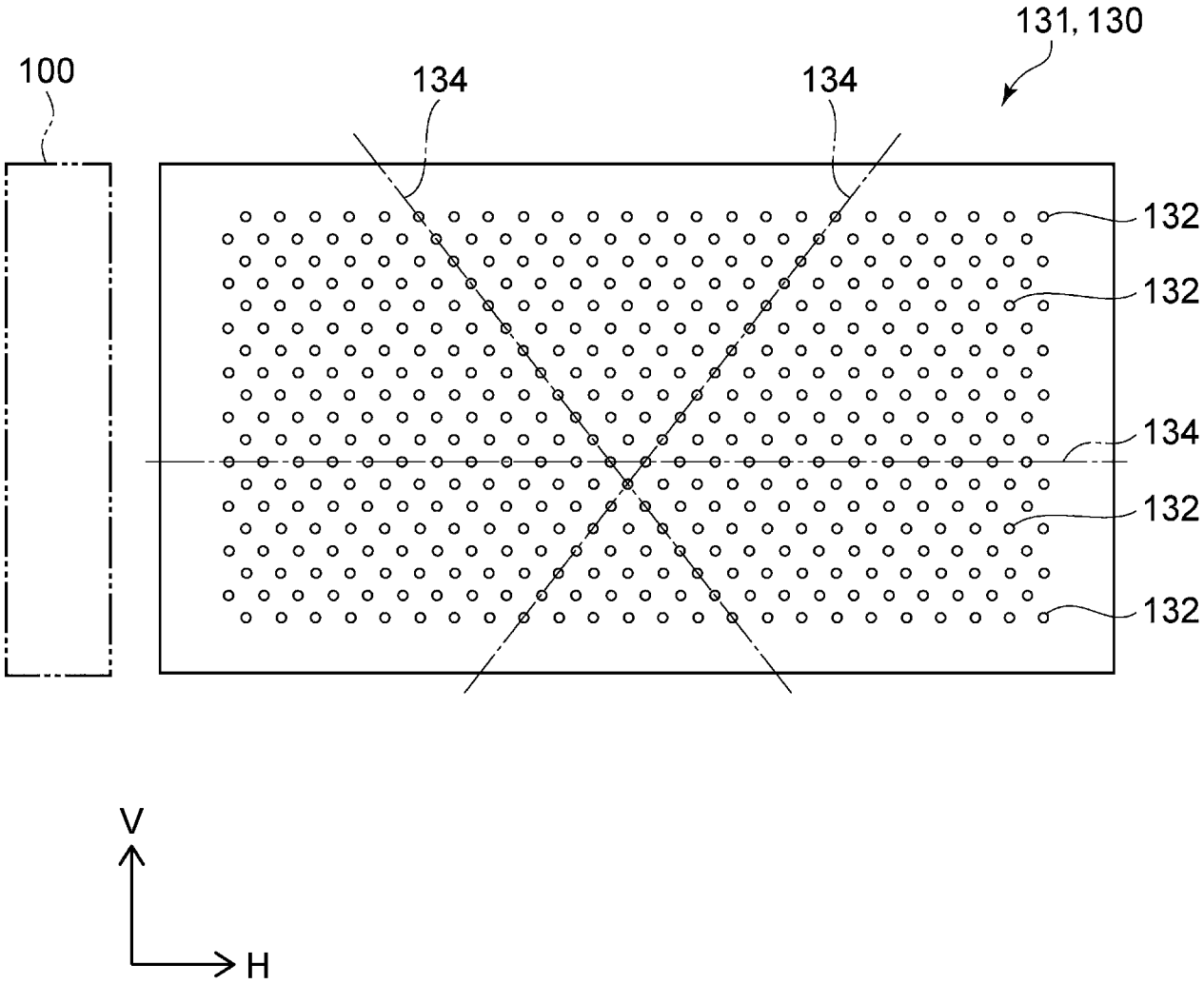
FIG. 6 is a side view illustrating a coolant injection surface of a cooling jacket according to a comparative example.

FIG. 6 is a side view illustrating a coolant injection surface of the cooling jacket according to the comparative example.

As illustrated in FIG. 6, in the cooling jacket according to the present comparative example, a coolant injection surface 131 of a coolant injection member 130 is provided with a plurality of injection holes 132. The injection holes 132 are substantially equal in size to one another. The plurality of injection holes 132 is substantially homogeneously distributed in the coolant injection surface 131. Adjacent three injection holes 132 are located at vertices of an equilateral triangle. That is, rows 134 in which the injection holes 132 are arranged at the shortest intervals extend in three directions forming an angle of 60 degrees with one another. One of this three directions is aligned with the horizontal direction H.

Next, the operation of the cooling jacket according to the comparative example will be described.

FIGS. 7A to 7D are views schematically illustrating the operation of the cooling jacket according to the present comparative example.

Figure 7A:
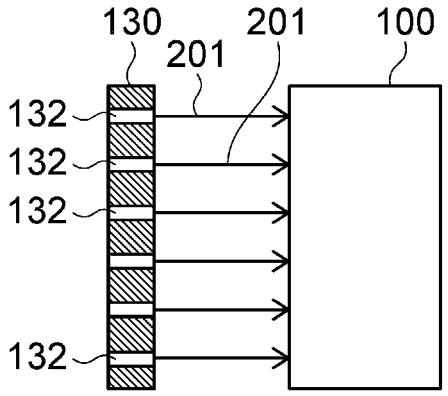
FIGS. 7A to 7D are views schematically illustrating an operation of the cooling jacket according to the comparative example.

As illustrated in FIG. 7A, the coolant 201 is injected from the injection holes 132 of the coolant injection member 130. Since the coolant injection surface 131 is provided with the plurality of injection holes 132 distributed substantially homogeneously, the injection amount of the coolant 201 is also substantially homogeneous.

Figure 7B:
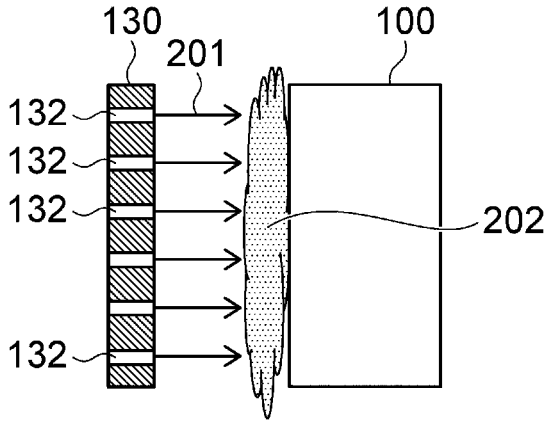

As illustrated in FIG. 7B, the coolant 201 evaporates by coming into contact with the workpiece 100, and forms the vapor layer 202 along the inner surface of the workpiece 100. The vapor layer 202 inhibits the coolant 201 injected thereafter from reaching the workpiece 100. In the present comparative example, since the injection amount of the coolant 201 is substantially homogeneous, an action of pushing out the vapor layer 202 up and down is small.

Figure 7C:
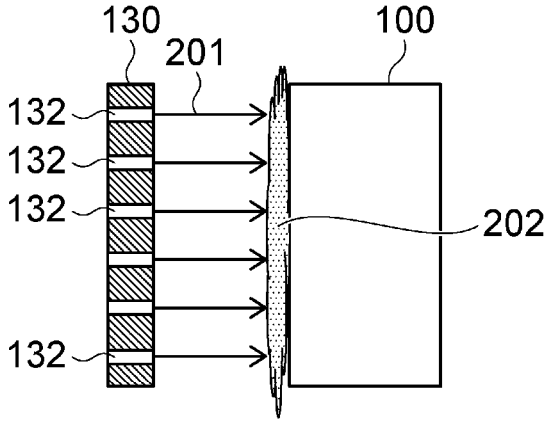
Figure 7D:
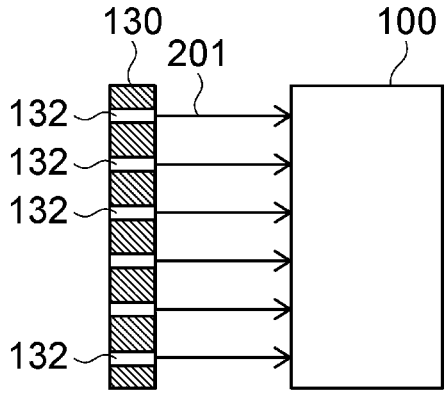

As illustrated in FIG. 7C, the vapor layer 202 gradually disappears by the coolant 201 injected thereafter. However, during that time, the coolant 201 is inhibited from reaching the workpiece 100, and the cooling efficiency of the workpiece 100 decreases.

As illustrated in FIG. 7 (*d*), when the vapor layer 202 is removed, the coolant 201 comes into contact with the workpiece 100 again. Due to this, the workpiece 100 is continuously cooled. Thus, in the comparative example, compared with the above-described embodiment, the discharge of the vapor layer 202 is slow and the cooling efficiency in the initial stage of the cooling process is low.

Test Example

Next, a test example presenting the above-described effect will be described.

Figure 8A:
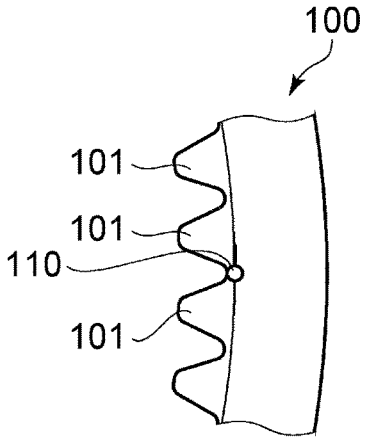
FIG. 8A is a partial cross-sectional view illustrating a workpiece used in a test example.
Figure 8B:
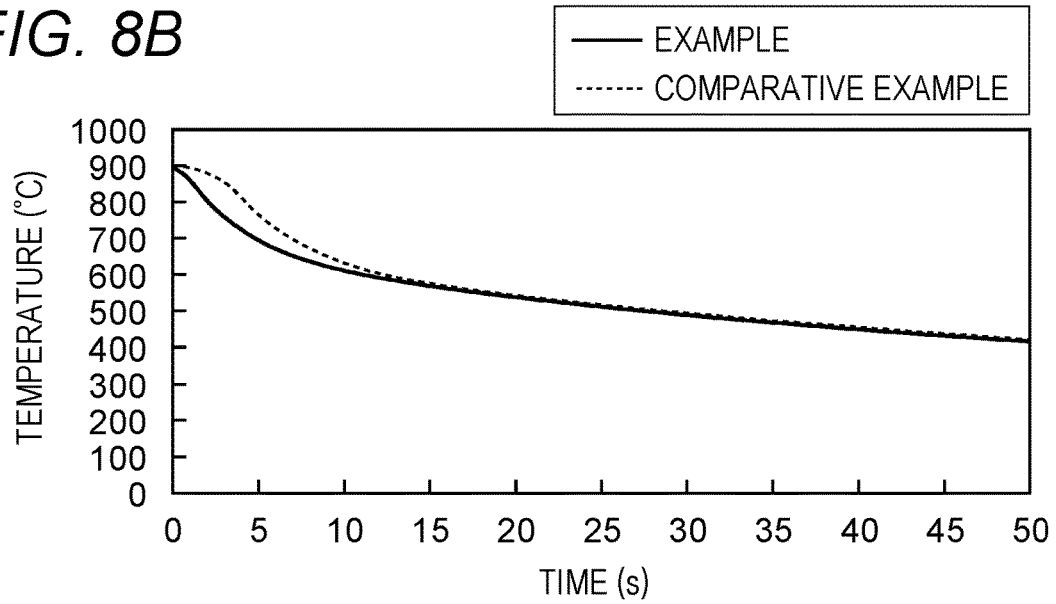
FIG. 8B is a graph illustrating a temperature change of the workpiece at the time of cooling with time on the horizontal axis and temperature on the vertical axis.
Figure 8C:
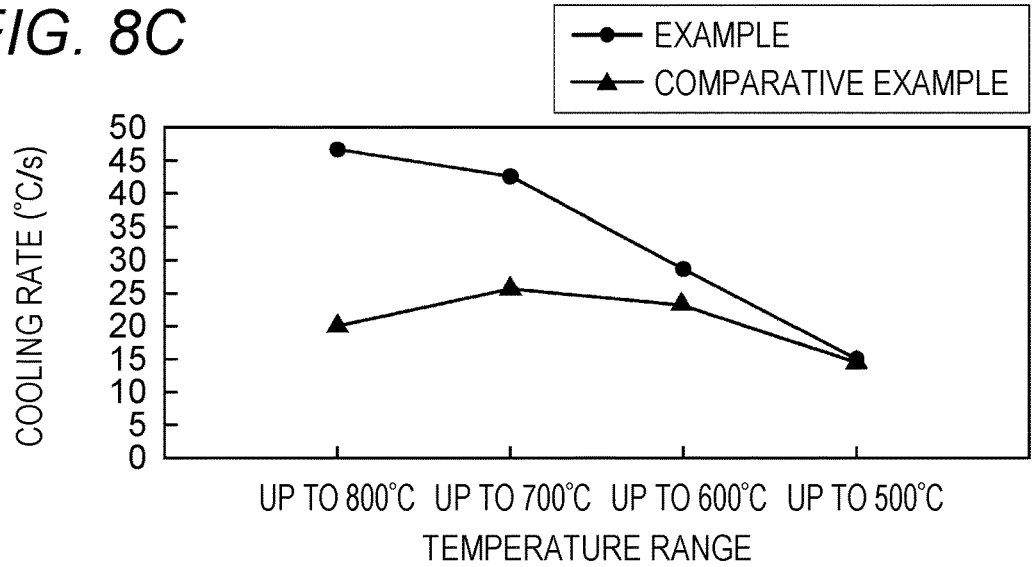
FIG. 8C is a graph illustrating a cooling rate in each temperature range with the temperature range at the time of cooling on the horizontal axis and the cooling rate on the vertical axis.

FIG. 8A is a partial cross-sectional view illustrating the workpiece used in the present test example, FIG. 8B is a graph illustrating a temperature change of the workpiece at the time of cooling with time on the horizontal axis and temperature on the vertical axis, and FIG. 8C is a graph illustrating the cooling rate in each temperature range with the temperature range at the time of cooling on the horizontal axis and the cooling rate on the vertical axis.

In the present test example, the cooling jacket according to the example described in the above-described embodiment and the cooling jacket according to the comparative example were prepared, quenching treatment was performed on the workpiece 100 using each of the cooling jackets, and the cooling rate was measured.

Hereinafter, the test conditions will be described.

As illustrated in FIG. 8A, in the present test example, a turning wheel provided with the teeth 101 on the inner surface was used as the workpiece 100. The material of the workpiece 100 was carbon steel S50C. The heating treatment was performed by high-frequency induction heating, and the heating temperature was up to a high temperature (910° C.) equal to or higher than the austenite transformation point at the tooth bottom center. A polymer solution having a predetermined concentration was used as a coolant.

In the cooling jacket according to the example, the coolant injection member 30 as illustrated in FIGS. 1 to 4 was used, the diameters of the injection holes 32 in the upper region and the lower region were set to 1.8 mm, and the diameter of the injection hole 33 in the central region was set to 2.4 mm. In the cooling jacket according to the comparative example, the coolant injection member 130 as illustrated in FIG. 6 was used, and the diameter of the injection hole 132 was set to 1.8 mm. A measurement position 110 for temperature was a position at the tooth bottom in the center of the vertical direction on the inner surface of the workpiece 100, the position 2 mm deep from the surface.

As illustrated in FIGS. 8B and 8C, in the case of using the cooling jacket according to the comparative example, the cooling rate of the workpiece 100 decreased in the initial stage of the cooling process, that is, in the temperature range of 910° C. to 800° C. On the other hand, in the case of using the cooling jacket according to the example, the cooling rate of the workpiece 100 was higher than that in the comparative example in the same temperature range. Thus, according to the example, the cooling rate in the center of the vertical direction at the initial stage of cooling was higher than that in the comparative example.

The above-described embodiment is an example in which the present invention is embodied, and the present invention is not limited to this embodiment. For example, the above-described embodiment with some components added, deleted, or modified is also included in the present invention. For example, the shape of the injection hole on the coolant injection surface is not limited to a circular shape, and may be, for example, a polygonal shape. The distance between the injection holes of the injection hole 33 adjacent to each other may be narrower than the distance between the injection holes of the injection hole 32 adjacent to each other. The direction in which the injection holes extend is not limited to the horizontal direction, and may be an obliquely downward direction or an obliquely upward direction. Furthermore, the coolant supply member 20 and the coolant injection member 30 may be integrally provided. The quenching apparatus may perform quenching treatment on the outer peripheral surface of the workpiece. In this case, the cooling jacket is disposed outside the workpiece and the moving unit is disposed inside the workpiece. The workpiece is not limited to the turning wheel.

DESCRIPTION OF REFERENCE SIGNS

1 Quenching apparatus
10 Cooling jacket
20 Coolant supply member
21 Plate member
30 Coolant injection member
31 Coolant injection surface
32, 33 Injection hole
34 Row
35 Upper region
36 Central region
37 Lower region
60 Moving unit
100 Workpiece
101 Teeth

110 Measurement position
130 Coolant injection member
131 Coolant injection surface
132 Injection hole
134 Row
201 Coolant
202 Vapor layer
C Central axis
D1 to D6 Distance
H Horizontal direction
V Vertical direction
W Densest direction

What is claimed is:

1. A cooling jacket comprising:

a coolant supply member that is a disk shape and circulates a coolant; and a coolant injection member to which the coolant is supplied from the coolant supply member, the coolant injection member attached to an outer peripheral surface of the coolant supply member and provided with a plurality of injection holes through which the coolant is injected, the coolant injection member being a ring shape, wherein a surface of the coolant injection member opposing a workpiece has an upper region, a central region, and a lower region arranged along a vertical direction, an area of each of the injection holes provided in the central region is larger than an area of each of the injection holes provided in the upper region and an area of each of the injection holes provided in the lower region, the coolant injection member moves relative to the workpiece in a horizontal direction, and a densest direction in which the plurality of injection holes are arranged at shortest intervals is inclined with respect to both the horizontal direction and the vertical direction.

2. The cooling jacket according to claim 1, wherein a length of the central region in the vertical direction is longer than a length of the upper region in the vertical direction and a length of the lower region in the vertical direction.

3. The cooling jacket according to claim 1, further comprising a plate member disposed below a gap between the coolant injection member and the workpiece.

4. The cooling jacket according to claim 1, wherein the workpiece has an annular shape, and the coolant injection member opposes an inner surface of the workpiece.

5. The cooling jacket according to claim 1, wherein the coolant supply member comprises two pieces of disk-shaped plates, a coolant circulation route in which the coolant circulates is formed between the two pieces of disk-shaped plates, and the coolant injection member connects the two pieces of disk-shaped plates in the vertical direction.

* * * * *